United States Patent [19]

Miller

[11] Patent Number: 4,518,042

[45] Date of Patent: May 21, 1985

[54] SUBSEA WELLHEAD CONNECTION ASSEMBLY

[75] Inventor: Henry W. Miller, Dallas, Tex.

[73] Assignee: Mobil Oil Corporation, New York, N.Y.

[21] Appl. No.: 536,803

[22] Filed: Sep. 28, 1983

[51] Int. Cl.[3] ..... E21B 43/013

[52] U.S. Cl. ..... 166/347; 166/360; 166/341; 166/368

[58] Field of Search ..... 166/347, 339, 341, 344, 166/368, 360, 343, 345, 85

[56] References Cited

U.S. PATENT DOCUMENTS

| | | | |
|---|---|---|---|
| 3,090,437 | 5/1963 | Geer | 166/341 |
| 4,191,256 | 3/1980 | Croy et al. | 166/343 |
| 4,437,521 | 3/1984 | Richardson et al. | 166/368 |
| 4,442,900 | 5/1984 | Padilla et al. | 166/342 |

*Primary Examiner*—Stephen J. Novosad
*Assistant Examiner*—M. Goodwin
*Attorney, Agent, or Firm*—Alexander J. McKillop; Michael G. Gilman; Charles J. Speciale

[57] ABSTRACT

A wellhead connector assembly for use on undersea template platform where a plurality of wellheads are connected to a center work enclosure hull having a plurality of penetration connectors projecting from its sidewall. The present assembly has a connector for fitting on the wellhead, and a laterally movable connector for coupling with a penetration connector. A vertical actuation rod pivots a bell crank linked to the connector to cause lateral movement thereof. A loop of pipe connects the wellhead to the laterally movable connector and biases it to a neutral position.

12 Claims, 7 Drawing Figures

SUBSEA WELLHEAD CONNECTION ASSEMBLY

BACKGROUND OF THE INVENTION

This invention relates generally to a subsea wellhead connection assembly for establishing fluid communication between a subsea wellhead and an adjacent subsea manifold assembly. In particular, the invention relates to a connection assembly for use in such a well system for handling oil and/or gas production from a multiplicity of subsea wells which are fed into a common point for subsequent transfer to a collection facility on the surface of the water.

The assignees of the present invention have developed a template for such an undersea collection system as disclosed in their copending applications, as will be later discussed.

In such subsea assemblies it is usual to have a horizontal platform or template adjacent to the sea bottom and of a generally circular configuration with a fluid tight work enclosure hull in the center of the template having a plurality of radially disposed lateral connectors or penetration means adapted to be connected to conduits coming from undersea wellheads. The wellhead connections pipes are usually brought to the underside of the template and face vertically upward. The template is divided into a plurality of radially extending generally pieshaped segments which are separated from each other by vertical partitions, usually in the form of welded pipes so as to define a group of stations, usually ten in number, which are circumferentially spaced about the template, radially outward of the previously mentioned center work enclosure hull. Such an underwater structure is preferably assembled in disconnectable portions which can be brought to the surface for repair and/or replacement as necessary.

The present assignee has copending U.S. patent application Ser. No. 343,634 filed Jan. 28, 1982 and application Ser. No. 371,901 filed Apr. 26, 1982 which are directed to related structures.

The wellhead connector assembly disclosed in copending application Ser. No. 371,901 comprises a body made up of a framework of about 3" diameter pipe or tubing welded or bolted together so as to form an upstanding frame, which is generally rectangular in side view and of a trapezoidal shape when viewed from the top. There is a centrally disposed wellhead connector means which forms the main connection going to the wellheads.

In that invention, wellhead connector 45 does not attach directly to wellhead 14, but is connected to a master valve assembly 50, which is secured to wellhead 14 for providing well shut-down capability and protection before the well is connected to manifold 39 within work enclosure hull 13. Master valve assembly 50, which may be of conventional construction, is installed on base template 11 before work enclosure hull 13 is installed. Connection is made to the penetration means by a laterally moveable manifold connector, which is connected to the wellhead connector by a loop of pipe.

SUMMARY OF THE INVENTION

The present invention contemplates a wellhead connection assembly having a frame similar to that of application Ser. No. 371,901, but has three principal differences: (a) there is an improved bell crank mechanism for lateral movement of the manifold connector; (b) the manifold connector is loosely held for axial movement in a resiliently mounted guide sleeve; and (c) the frame is constructed with means for adjusting the position of the portion of the frame carrying the manifold connector in relation to the remainder of the frame, so as to adjust the manifold connector in relation to the penetration means. This frame is designed to fit within one of the template circumferentially separated sections with a loop of pipe, similar to that of said prior application, to run from the upwardly facing wellhead connection on the template to the penetration means horizontally projecting from the side of the central work enclosure hull.

It is an object of the present invention to furnish such a connection means which is capable of being lowered into the water with its manifold system connector in a withdrawn position so as to avoid damage thereto and for that manifold connector to be readily radially moveable (in relation to the template) so as to connect with the lateral penetration means projecting from the template work enclosure hull.

Another object is to allow flexibility for misalignment that can be corrected when the manifold connector and penetration means are mated together.

Another object of this invention is to provide an improved mechanical linkage, using a bell crank, for laterally moving the manifold connector.

It is a further object of the present invention to provide a wellhead connecting means which places a minimum amount of stress on the piping loop in the wellhead connection assembly after it is placed in service.

DESCRIPTION OF THE PREFERRED EMBODIMENT

Figure 1:
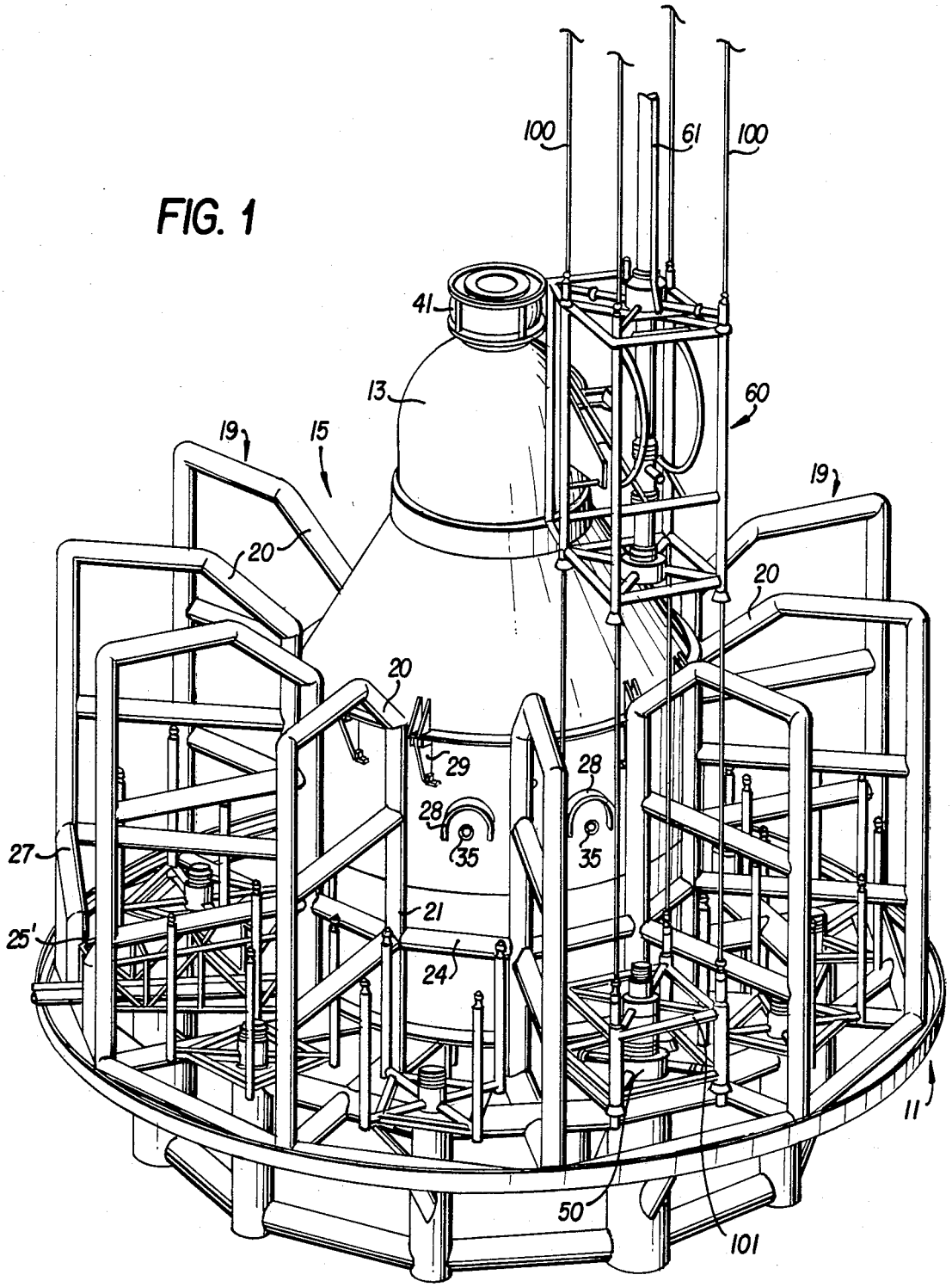
FIG. 1 is a perspective view of an undersea template for placement of a plurality of wellhead connectors and a wellhead connection assembly being lowered into its station on the template.

The present invention, as previously stated, is an improvement upon the wellhead connector assembly shown in assignee's copending application Ser. No. 371,901, the disclosure of which is hereby incorporated by reference in its entirety. For the sake of convenience and understanding, the same reference numerals are used herein, to the extent possible, as used in that copending application.

FIG. 1 of this application is substantially identical to FIG. 9 of that copending application and is furnished by way of background. As stated in that copending application, FIG. 9 (FIG. 1 herein) illustrates an embodiment in which conventional guidelines 100 are used for installing the wellhead connection assembly 15 rather than a guidelineless installation. Either installation procedure may be used in connection with the present invention.

As embodied herein, conduit 42 comprises at least one, and preferably two or three, conventional flexible flowline loops 51. These loops must be able to flex sufficiently to accommodate the coupling and uncoupling of manifold system connector 56 and horizontal penetrator 35. Additionally, in those preferred embodiments where it is desired to pass conventional pump-down tools down the well, flowline loops 51 must include no bends having a radius less than 1.52 meters, in order to accommodate passage of the tools. As stated in application Ser. No. 371,901, it has been determined that, for such embodiments, configuration of flowline loops 51 in substantially vertically aligned loops extending about one full turn, is preferred. On the other hand, where pump-down tool capability is not required, configuration of flowline loops 51 in substantially horizontally aligned loops extending about one and one-half full turns is preferred. Such an embodiment does not require a 1.52 meters minimum bending radius for loops 51 and provides a more compact assembly 15. Elements corresponding generally to those shown in the other Figures and discussed elsewhere herein bear identical reference numerals. The production flowlines and hydraulic control lines (not shown) in wellhead 14 (or master valve assembly 50) interface with corresponding production passages and hydraulic control passages (not shown) extending through wellhead connector 45 and flowlines 51, using conventional subsea male stab subs and female receptacles (not shown) mounted on the top of wellhead 14 (or master valve assembly 50) and the bottom of connector 45. Conventional techniques for establishing the operative connections, commonly referred to as "stabbing over", may be used.

As further embodied herein, and as best shown in FIGS. 3 and 5–7, manifold system connector 56 comprises a conventional horizontal flowline connector for establishing operative fluid communication between subsea atmospheric manifold system penetrator 35 and the horizontally extending end 43 of conduit 42. For a more complete description of the construction and operation of one suitable conventional manifold system connector 56 and penetrator 35, attention is invited to U.S. Pat. No. 4,191,256 (Croy), which is hereby specifically incorporated by reference.

Preferably, manifold system connector 56 and penetrator 35 are designed to permit the use of the smallest possible penetration through subsea work enclosure hull 13, and are mechanically actuated and hydraulically locked and unlocked.

Manifold system connector 56 is preferably mounted for axial sliding motion within a tubular guide sleeve 118 which has lateral keyways 83 on opposite inner sides thereof. Keys 82 project outwardly from opposite sides of connector 56 and are loosely received in keyways 83, so as to permit axial sliding movement of the connector 56, while preventing the connector from rotating about its own axis. A pair of tongues 119, projecting radially outward from opposite sides of guide sleeve 118, are received in elastomeric spring 122, which are in turn secured to guide brackets 84, bolted by means of bolts 127 to frame 60. Bolts 127 are received in slotted holes to permit adjustment, as will be later discussed. Manifold system connector 56 is preferably laterally moved into operative connection with penetrator 35 through the use of mechanical linkage means, illustratively shown as a mechanical linkage comprising actuating rod 85, bell crank 103 and associated parts to be later described.

As embodied herein, the mechanical linkage is constructed so that manifold system connector 56 is laterally moved by downward movement of vertically aligned actuating rod 85, which is supported by plate 95 and attached to the top portion of guide frame 60, which downward movement is translated into lateral movement by bell crank 103, connected to slide fork 108 that exerts force through plates 109 against the end of the connector to extend it forward. Similarly, upward movement of actuating rod 85 through coupling 89 retracts manifold system connector 56 from contact with penetrator 35 when slide fork 108 retracts yoke 112 attached to connector through pins 114, as will be later described. Once manifold system connector 56 is in the proper position, it is preferably hydraulically locked to penetrator 35 by pressurizing through the running tool in a conventional manner.

Conventional hydraulic controls extend from the running tool to a remote surface facility in a known manner.

Preferably, conventional hydraulic control stab plates are located at both the top and bottom of wellhead connection assembly 45 for engaging the running tool and the wellhead (or the master valve assembly), respectively, in a conventionally known manner. Multiple control lines from manifold system connector 56 are preferably plumbed directly to the upper stab plate.

Connected between the wellhead connector 45 and the manifold connector 56 are two flex loop assemblies 51 which are pieces of high strength steel pipe bent, preferrably, in a complete circle, one being of $4\frac{1}{8}''$ diameter and the other being 2 1/16" diameter of seamless construction both built to withstand 5,000 psi internal working pressure. The connector 56 is mounted for lateral movement toward and away from connection with penetration connector 35 (see FIG. 1 and the aforesaid copending application for details). The connector used in a preferred embodiment is a commercially available hydraulic operated collet connector with metal-to-metal seals on the connecting bores.

Figure 2:
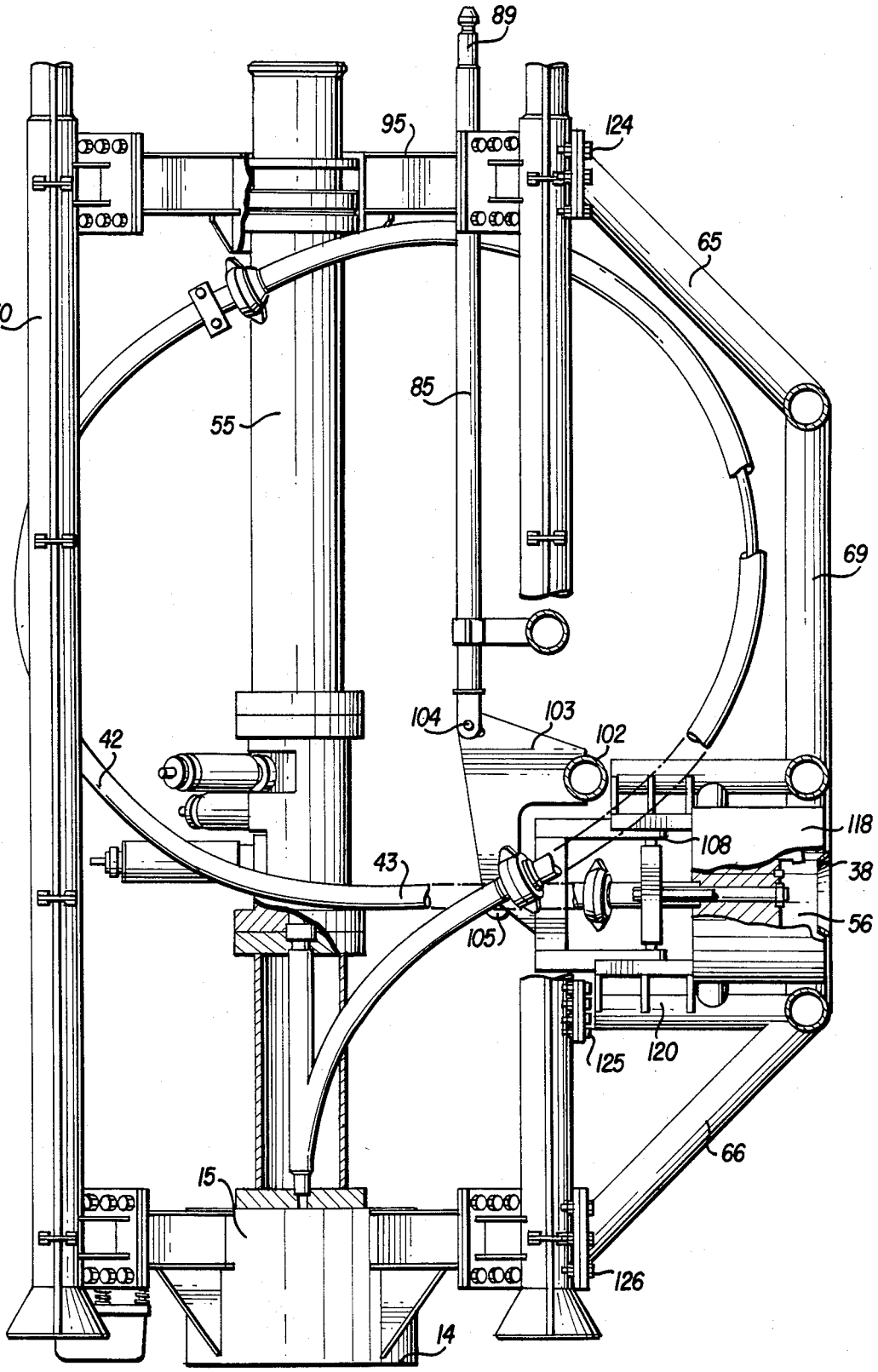
FIG. 2 is a side view, partially in section, showing the wellhead connector assembly of the present invention.
Figure 3:
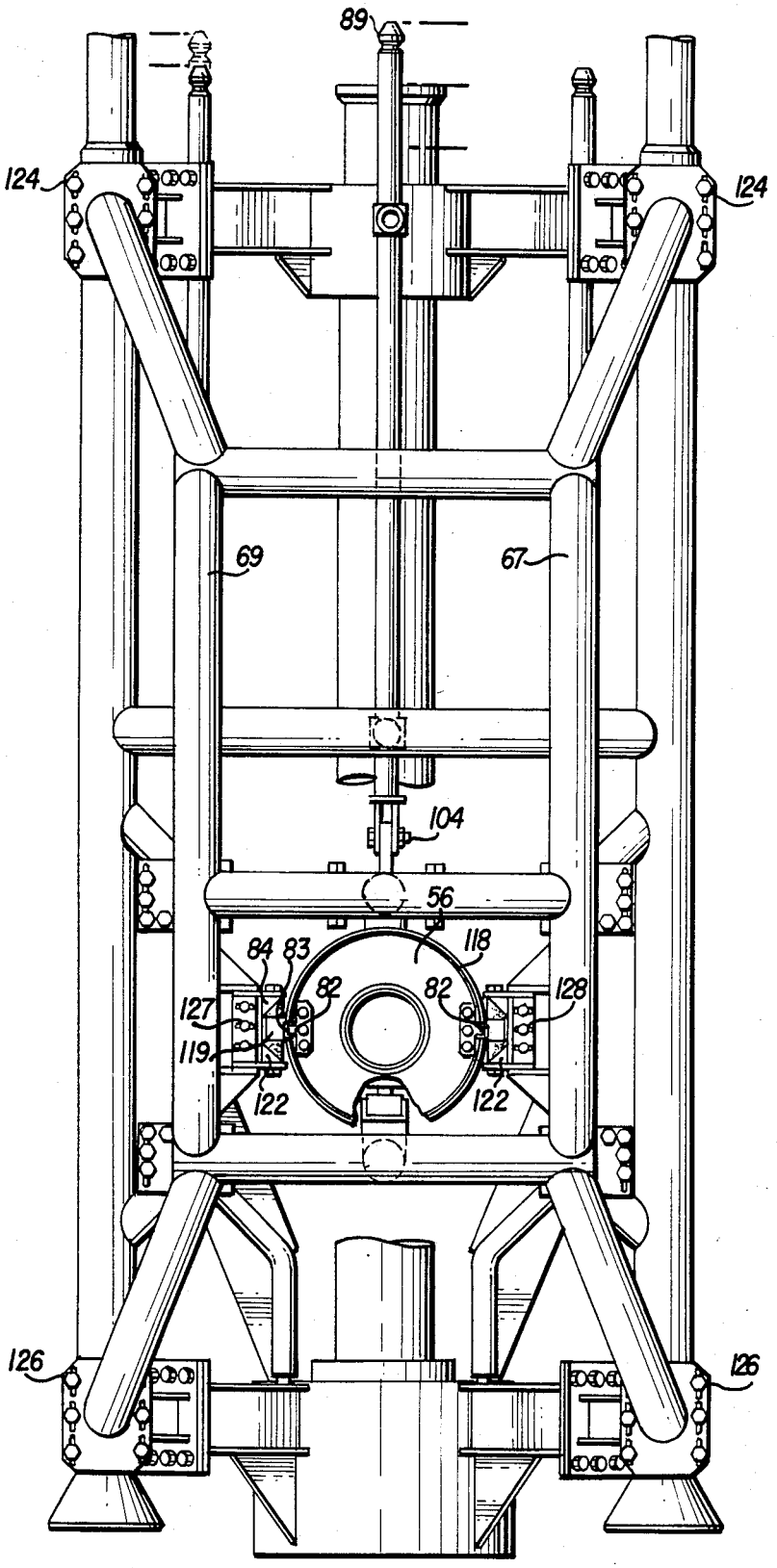
FIG. 3 is a front elevational view of the present invention (taken from the right side of FIG. 2)
Figure 4:
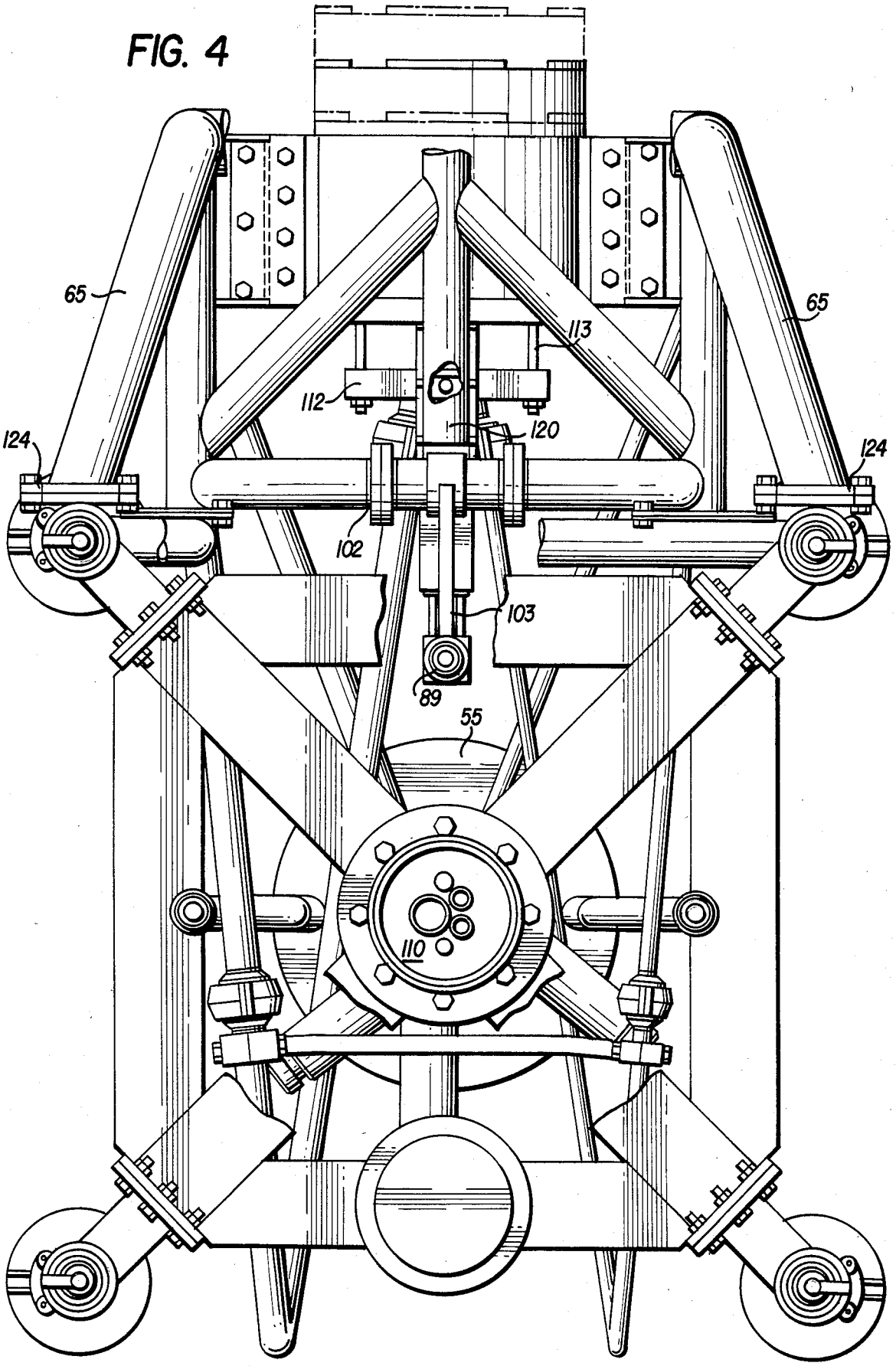
FIG. 4 is a top view of the wellhead connector assembly shown in FIGS. 1 and 2.

When the present wellhead connector assembly is lowered into place on the undersea template it is necessary that the connector 56 be withdrawn as far as possible toward the left, as shown in FIG. 2, so as to avoid striking protector shroud 28 or the penetration connector 35 to which it will later be engaged. Protector shroud 28 is made of heavy metal, shaped as an inverted "U" and secured to the side of hull enclosure 13 just above and to the sides of penetrator 35 to permit room for the connector 56 to engage penetrator 35. It projects vertically outwardly, just past the outward projection of penetrator 35. It is necessary to have means for moving the connector 56 laterally (to the left and right as shown in FIG. 2) away from its ultimate engagement while the assembly is lowered in place and, at the opposite (right) end of its stroke, to engage the penetration connector 35. The total length of this stroke is about 14". As previously mentioned the flex loop 51 is made of a relatively stiff steel tubing which would have a tendency to bias the movement of the connector depending upon the normal diameter of the flex loop. Applicants have found that it is undesirable to use the flex loop to bias the connector in either one of its extreme positions and therefore the normal diameter of the flex loop is set so as to maintain the connector in a neutral position which is about halfway between the two extremes of its stroke. The connector 56 is moved along its stroke by means of actuating rod 85, as previously discussed. This rod is pivotally connected to a bell crank 103, which is mounted for pivotal movement about pivot point 102 by means of a pin 104 at the end of rod 85 which is held for its vertical movement in a support 106 secured to the frame of the connector assembly body. The bell crank is pivotally connected by a second pivot pin 105 to a slide fork 108, which in turn moves connector 56. This Cameron SK-18223 connector (made by Cameron Iron Works) or a suitable connector by other suppliers, is a female of the multiple actuator collet type, with hydraulic latch and unlatch functions, emergency hydraulic unlatch and mechanical release by override and capable of withstanding 10,000 psi. There are two principal bores through the connector body one 2 1/6" and the other 4⅛" with a provision for metal to metal seal rings on the mating surfaces and seal pockets for O ring seal subs on the studded flange surface. A plurality of independent hydraulic passages are provided in addition to an electrical connector half with a mechanical orientation stab around it, as previously mentioned.

Suitable detent means may be provided in connection with the actuating rod 85 or the slide fork 108, for example on yoke pivot 102, so as to provide an ascertainable neutral position where the flex loops are not stressed, although this is generally not necessary due to the strength of the pipe flex loops. Pulling up on actuating rod 85 pulls the slide fork 108 to the left, as shown in FIG. 2. This withdraws the connector 56 to its extreme inward position.

Figure 5:
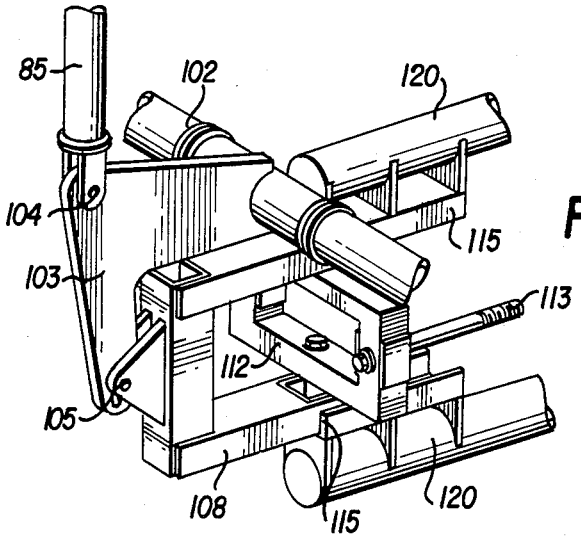
FIG. 5 is a detailed perspective view of a portion of the assembly of FIG. 2, showing the bell crank actuation mechanism of the manifold system connector.
Figure 6:
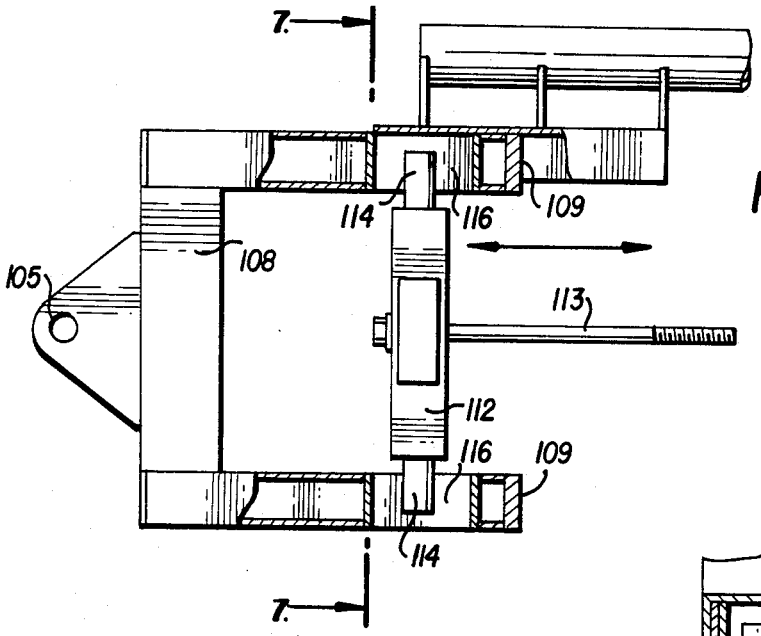
FIG. 6 is a side view, partially in section, of a portion of the manifold system connector.
Figure 7:
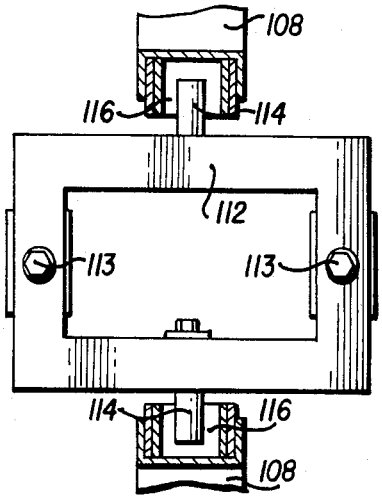
FIG. 7 is a front view of the connector of FIG. 6.

Referring now to FIGS. 5–7, slide fork 108 has free end plates 109 which bear against the rear of connector 56 to push it forward (to the right in FIGS. 5 and 6) to engage with the penetration connector. Slide fork 108 carries a rectangular yoke 112 by means of pivot pins 114, which extend into opening 116 in the slide fork. These openings are much larger than, about twice, the diameter of the pins 114, both in side-to-side dimensions (see FIG. 7) and front-to-back dimensions (see FIG. 6). As a result, the pins in the space form a lost motion connector which permits considerable freedom of movement in alignment of the bell crank mechanism with the connector 56, which is relatively movable as compared with the bell crank. Similarly, the rear end of connector 56 may move in relation to the free ends 109 of the slide fork 108. This freedom of movement greatly facilitates alignment of the connector 56 in relation to the actuator mechanism and bell crank which are relatively fixed. Extending forwardly from yoke 112 is a pair of bolts 113 which engage the connector 56 for mechanical release thereof, in case its internal hydraulic release is not working. Slide fork 108 moves in a pair of "U"-shaped channels 115 (see FIG. 5), which are mounted to frame members 120. The slide fork 108 and the rectangular yoke leave the center of the connector 56 open for connection of the steel tubes, such as 43. The connection of these tubes in FIGS. 5–7 is not shown for sake of clarity.

The connector 56 is carried in a connector guide sleeve 118, which is used to pre-align the connector 56 with the penetrator 35. The guide sleeve controls the connector 56 in a loose fit in horizontal, vertical and rotational alignment, allowing the connector to move only along the axis of insertion. Control is achieved by keyways 83, as previously mentioned.

Guide sleeve 118 is resiliently secured to the frame members by means of elastomer springs 122 so as to permit limited free travel for alignment with penetrator 35.

Alignment of manifold connector 56 with penetrator 35 is greatly facilitated by a guide cone 38 (see FIG. 2) carried by connector 56. This funnel-shaped cone 38 faces toward penetration 35 and, as the connector 56 is moved forward toward penetrator 35 if the alignment is not correct, the inclined face of cone 38 will contact penetrator 35 and slide the connector in the necessary direction (up, down or sideways) so that alignment will be achieved by movement of the connector 56 in relation to guide sleeve 118 and/or movement of the guide sleeve 118 upon elastomer springs 122, as previously described.

Prior to lowering the wellhead connector assembly to the undersea template, measurements are taken by applicable gauging tools to ascertain the vertical and horizontal location of a penetrator 35 in relation to a particular template station so that the connector assembly can be adjusted if needed. That is, in some cases it is necessary to shift the vertical and/or horizontal position of connector 56 in relation to the frame of the connector assembly. This is done for vertical adjustment by loosening bolts 124–126 and moving the entire section of frame, including members 65, 66, 67, 68, 69 and 120, in relation to the remainder of the frame, by slotted holes associated with those bolts, see FIGS. 2 and 3. Horizontal adjustments are accomplished by bolts 127 and 128 and slots associated therewith. This macro adjustment can be plus or minus 3 inches with the slotted bolt holes. The elastomer mounting will permit a micro adjustment of a minimum of 1 inch.

I claim:

1. A wellhead connector assembly comprising:

a support frame of tube members defining a structure for fitting onto an undersea template supported adjacent the sea bottom, said template having a plurality of positions for receiving a wellhead connector assembly, each position having an upwardly facing wellhead connection outlet means and a lateral penetration connector spaced therefrom and along one side;

a wellhead connector at the bottom of said support frame for engaging said wellhead connection outlet means;

a manifold system connector on one side of said support frame for engaging said lateral penetration connector;

a loop of pipe carried by said support frame connecting said wellhead connector to said manifold system connector;

means on said support frame mounting said manifold system connector for lateral movement toward and away from said lateral penetration connector, said means comprising:

a bell crank pivotally mounted on said support frame adjacent and pivotally linked to said manifold system connector and to a generally vertically extending actuation rod so that upward and downward movement of said actuating rod causes pivoting of said bell crank and lateral movement of the manifold system connector toward and away from said lateral penetration connector.

2. The assembly of claim 1, including means for mounting said manifold system connector for vertical and horizontal movement in relation to said support frame to facilitate alignment with said lateral penetration connector.

3. The assembly of claim 1, in which one leg of said bell crank is pivotally linked to a "U"-shaped slide fork, the free ends of which bear against the manifold system connector.

4. The assembly of claim 3, in which there is a rectangular yoke carried by said U-shaped slide fork and means mechanically connecting said yoke to said manifold system connector.

5. The assembly of claim 4, in which the yoke is pivotally connected to the U-shaped member.

6. The assembly of claim 5, including a lost motion connection means between said U-shaped slide fork and said yoke.

7. The assembly of claim 6, in which said lost motion connection means is a pin extending into each leg of said "U", the pins being received in openings larger than the diameter of said pins to permit two directions of movement.

8. The assembly of claim 1, in which the loop of pipe is bent to a radius in which, in an unstressed position, will hold said manifold system connector in a lateral position between its extreme inward and extreme outward limit of lateral travel.

9. The assembly of claim 1, in which said support frame carries a resiliently mounted guide sleeve and said manifold system connector is mounted for axial movement within said guide sleeve.

10. The assembly of claim 9, including at least two elastomer springs between the guide sleeve and the support frame so as to permit limited free travel for alignment with the penetration connector.

11. The assembly of claim 9, in which said guide sleeve is mounted to a portion of the support frame which is movable in relation to the remainder of the support frame by means of detachable fastening means.

12. A wellhead connector assembly comprising:

a support frame of tube members defining a structure for fitting onto an undersea template supported adjacent the sea bottom, said template having a plurality of positions for receiving a wellhead connector assembly, each position having an upwardly facing wellhead connection outlet means and a lateral penetration connector spaced therefrom along one side;

a wellhead connector at the bottom of said support frame for engaging said wellhead connection outlet means;

a guide sleeve on one side of said support frame mounted to be in general alignment with said penetration connector when said support frame is in position on said undersea template;

a manifold system connector mounted within said guide sleeve for lateral movement toward and away from said penetration connector;

means for laterally moving said manifold system connector comprising:

a bell crank pivotally mounted on said support frame, a generally vertically extending actuation rod pivotally linked to said bell crank and linkage means between said bell crank and said manifold system connector, comprising a U-shaped member mounted for sliding movement toward and away from said manifold assembly connector, with the free ends of the U bearing against the connector, and a rectangular frame pivotally connecting within the U-shaped member and having means securing the frame to the manifold assembly connector so that upward and downward movement of the actuation rod causes lateral movement of the manifold assembly connector;

a loop of pipe carried by said support frame connecting said wellhead connector to said manifold system connector and bent to a radius so as to bias said manifold system connector to a lateral position between its extreme inward and extreme outward position.

* * * * *